US011749159B2

(12) United States Patent
Byeon et al.

(10) Patent No.: US 11,749,159 B2
(45) Date of Patent: Sep. 5, 2023

(54) GATE DRIVER CIRCUIT AND METHOD FOR DRIVING THE SAME

(71) Applicant: LX Semicon Co., Ltd., Daejeon (KR)

(72) Inventors: Jin Su Byeon, Daejeon (KR); Cheol Ho Lee, Daejeon (KR); Yoon Soo Shin, Daejeon (KR)

(73) Assignee: LX SEMICON CO., LTD., Daejeon (KR)

( * ) Notice: Subject to any disclaimer, the term of this patent is extended or adjusted under 35 U.S.C. 154(b) by 0 days.

(21) Appl. No.: 17/863,313

(22) Filed: Jul. 12, 2022

(65) Prior Publication Data

US 2023/0043062 A1 Feb. 9, 2023

(30) Foreign Application Priority Data

Aug. 4, 2021 (KR) ..... 10-2021-0102699

(51) Int. Cl.
*G09G 3/20* (2006.01)

(52) U.S. Cl.
CPC ..... *G09G 3/20* (2013.01); *G09G 2310/0267* (2013.01); *G09G 2310/0291* (2013.01); *G09G 2330/021* (2013.01)

(58) Field of Classification Search
CPC ..... G09G 3/3266; G09G 3/3674–3681; G09G 2310/0267; G09G 2310/0289
See application file for complete search history.

(56) References Cited

U.S. PATENT DOCUMENTS 7,750,715 B2 * 7/2010 Hsu ..... G09G 3/3611 341/122
8,436,801 B2 * 5/2013 Hsu ..... G09G 3/3677 345/204
8,896,586 B2 * 11/2014 Wu ..... G09G 3/3677 345/694
10,389,357 B2 * 8/2019 Shin ..... G09G 3/3648
10,930,191 B2 * 2/2021 Tian ..... G11C 19/28
11,011,128 B1 * 5/2021 Gao ..... G09G 3/3677
11,263,977 B2 * 3/2022 Kim ..... G09G 3/3266
11,309,389 B2 * 4/2022 Kang ..... H01L 21/02529
2010/0109995 A1 * 5/2010 Fang ..... G09G 3/3677 345/100
2010/0134172 A1 * 6/2010 Hsu ..... H03K 19/0013 327/296
2011/0169723 A1 * 7/2011 Hsu ..... H03K 19/0175 345/100
2012/0038622 A1 * 2/2012 Cheng ..... G09G 3/20 327/333
2012/0154361 A1 * 6/2012 Wu ..... G09G 3/3677 345/211
2018/0137804 A1 * 5/2018 Choi ..... G09G 3/2092
2020/0082747 A1 * 3/2020 Tian ..... G11C 19/28
2021/0125574 A1 * 4/2021 Gao ..... G09G 3/3677
2021/0183318 A1 * 6/2021 Kim ..... G09G 3/3266
2022/0208058 A1 * 6/2022 Hwang ..... G09G 3/3258
2022/0343819 A1 * 10/2022 Shih ..... G09G 3/20

FOREIGN PATENT DOCUMENTS

KR 101110565 B1 2/2012

* cited by examiner

*Primary Examiner* — Patrick F Marinelli
(74) *Attorney, Agent, or Firm* — POLSINELLI PC

(57) ABSTRACT

Provided are a gate driver circuit used in a display device and a method for driving the same. Charge sharing is adaptively achieved according to the phase of a clock signal outputted by the output ends of buffers in the gate driver circuit, so that power consumed when a gate line is driven can be reduced.

14 Claims, 9 Drawing Sheets

GATE DRIVER CIRCUIT AND METHOD FOR DRIVING THE SAME

CROSS REFERENCE TO RELATED APPLICATION

This application claims priority from Republic of Korea Patent Application No. 10-2021-0102699 filed on Aug. 4, 2021, which is hereby incorporated by reference in its entirety.

BACKGROUND

1. Field of Technology

The present disclosure relates to a gate driver circuit and a method for driving the same.

2. Description of the Prior Art

In general, a display device includes a display panel, a display driving device, a timing controller, and the like.

The display driving device converts digital image data provided by the timing controller into a source signal, and provides the source signal to the display panel. The display driving device may include a gate driver integrated into a chip.

The gate driver serves to drive a gate line by transmitting a gate driving signal to the display panel.

In order for the display panel to output a normal image, a method in which a system circuit dynamically controls and adjusts the output of the gate driver is required. However, such a method may cause the system circuit to consume a large amount of power. Thus, in order to solve such a problem, a charge sharing function may be used.

SUMMARY OF THE INVENTION

Under such a background, in one aspect, various embodiments are directed to providing a circuit suitable for reducing power consumption by automatically applying a charge sharing function according to an operation of a clock signal without directly designating a channel in which the charge sharing function is performed, and a method for driving the same.

In one aspect, the present embodiment may provide a gate driver circuit including: a control circuit configured to output gate clock signals and connection control signals; a plurality of buffers configured to respectively receive the gate clock signals and to output the gate clock signals; and a plurality of charge sharing switches configured to respectively control connections between output ends of the buffers so as to connect selected buffers among the plurality of buffers through a charge sharing line and to be controlled respectively by the connection control signals.

In another aspect, the present embodiment may provide a gate driver circuit, including: a control circuit to output gate clock signals and connection control signals; a first buffer to receive a first gate clock signal from the control circuit and to output the first gate clock signal; a second buffer to receive a second gate clock signal from the control circuit and to output the second gate clock signal; a first charge sharing switch connected to an output end of the first buffer and controlled by the connection control signal; a second charge sharing switch connected with an output end of the second buffer, connected with the first charge sharing switch through a charge sharing line, and controlled by the connection control signal.

In still another aspect, the present embodiment may provide a method for driving a gate driver circuit, including: transmitting gate clock signals respectively to a plurality of buffers; transmitting a first gate clock signal and a second gate clock signal respectively to a first buffer and a second buffer among the plurality of buffers; turning on charge sharing switches corresponding to an output end of the first buffer and an output end of the second buffer when the first gate clock signal and the second gate clock signal are respectively in different edge states; and connecting the output end of the first buffer and the output end of the second buffer through a charge sharing line.

In still another aspect, the present embodiment may provide a method for driving a gate driver circuit, including: transmitting a first gate clock signal to a first buffer; transmitting a second gate clock signal to a second buffer; turning on the first charge sharing switch connected with the first buffer and the second charge sharing switch connected with the second buffer when the first gate clock signal and the second gate clock signal are respectively in different edge states; and connecting an output end of the first buffer and an output end of the second buffer through a charge sharing line.

As is apparent from the above, according to the present embodiments, it is possible to select a channel, in which charge sharing is to be adaptively achieved according to the phase of a clock signal. Furthermore, according to the present embodiments, power consumed by a display device when a gate line is driven is reduced.

DETAILED DESCRIPTION OF THE EXEMPLARY EMBODIMENTS

Figure 1:
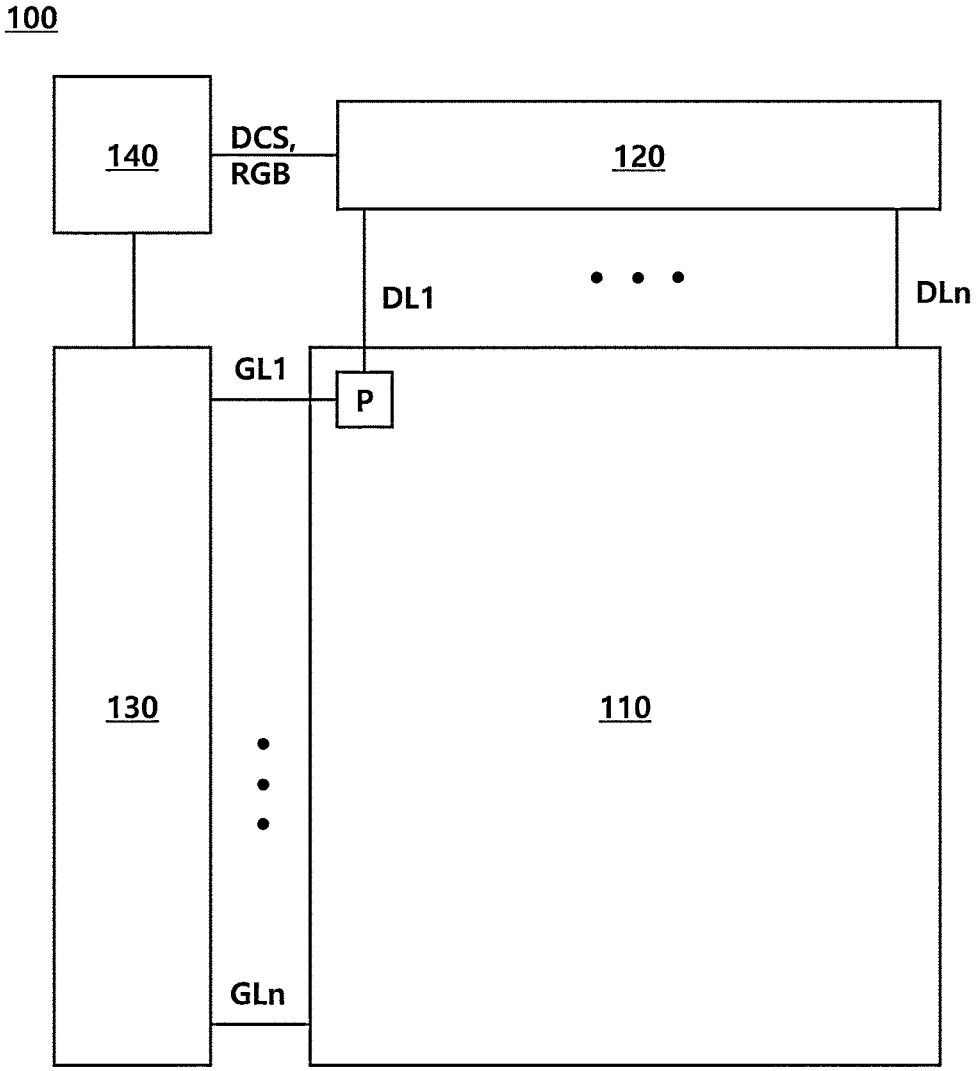
FIG. 1 is a configuration diagram of a display device in accordance with an embodiment.

FIG. 1 is a configuration diagram of a display device 100 in accordance with an embodiment.

Referring to FIG. 1, the display device 100 may include a panel 110, and a data driving circuit 120, a gate driving circuit 130 and a data processing circuit 140 that drive the panel 110.

In the panel 110, a plurality of data lines DL and a plurality of gate lines GL may be disposed, and a plurality of pixels P may be disposed.

The circuits, which drive at least one configuration included in the panel 110, may be referred to as panel driving circuits. For example, the data driving circuit 120, the gate driving circuit 130, the data processing circuit 140, and the like may be referred to as panel driving circuits.

Each of the aforementioned data driving circuit 120, gate driving circuit 130, and data processing circuit 140 may be referred to as a panel driving circuit, and all or a plurality of circuits may be referred to as a panel driving circuit.

The data driving circuit 120 may drive the plurality of data lines DL.

The gate driving circuit 130 may drive the plurality of gate lines GL by supplying a scan signal (also referred to as a 'gate signal') to the plurality of gate lines GL.

The data processing circuit 140 may control the data driving circuit 120 and the gate driving circuit 130 by supplying various control signals to the data driving circuit 120 and the gate driving circuit 130.

In the panel driving circuit, the gate driving circuit 130 may supply a scan signal having a turn-on voltage or a turn-off voltage to the gate line GL. When the scan signal having the turn-on voltage is supplied to a pixel P, the pixel P is connected to the data line DL, and when the scan signal having the turn-off voltage is supplied to the pixel P, the pixel P is disconnected from the data line DL.

In the panel driving circuit, the data driving circuit 120 supplies a data voltage to the data line DL. The data voltage supplied to the data line DL is transferred to the pixel P, which is connected to the data line DL, according to the scan signal.

In the panel driving circuit, the data processing circuit 140 may supply various control signals to the gate driving circuit 130 and the data driving circuit 120. The data processing circuit 140 may generate a gate control signal GCS for staring a scan according to a timing implemented in each frame, and transmit the gate control signal GCS to the gate driving circuit 130. Furthermore, the data processing circuit 140 may output, to the data driving circuit 120, image data RGB obtained by converting externally inputted image data according to a data signal format used by the data driving circuit 120. Furthermore, the data processing circuit 140 may transmit a data control signal DCS for controlling the data driving circuit 120 to supply a data voltage to each pixel P according to each timing.

Meanwhile, the data driving circuit 120 may be referred to as a source driver. Also, the gate driving circuit 130 may be referred to as a gate driver. Also, the data processing circuit 140 may be referred to as a timing controller.

Although the present embodiment is not limited by such names, descriptions of some components generally known in the source driver, the gate driver, the timing controller, and the like will be omitted from the description of the following embodiment. Accordingly, in understanding the embodiment, it is necessary to consider that these some components have been omitted.

Figure 2:
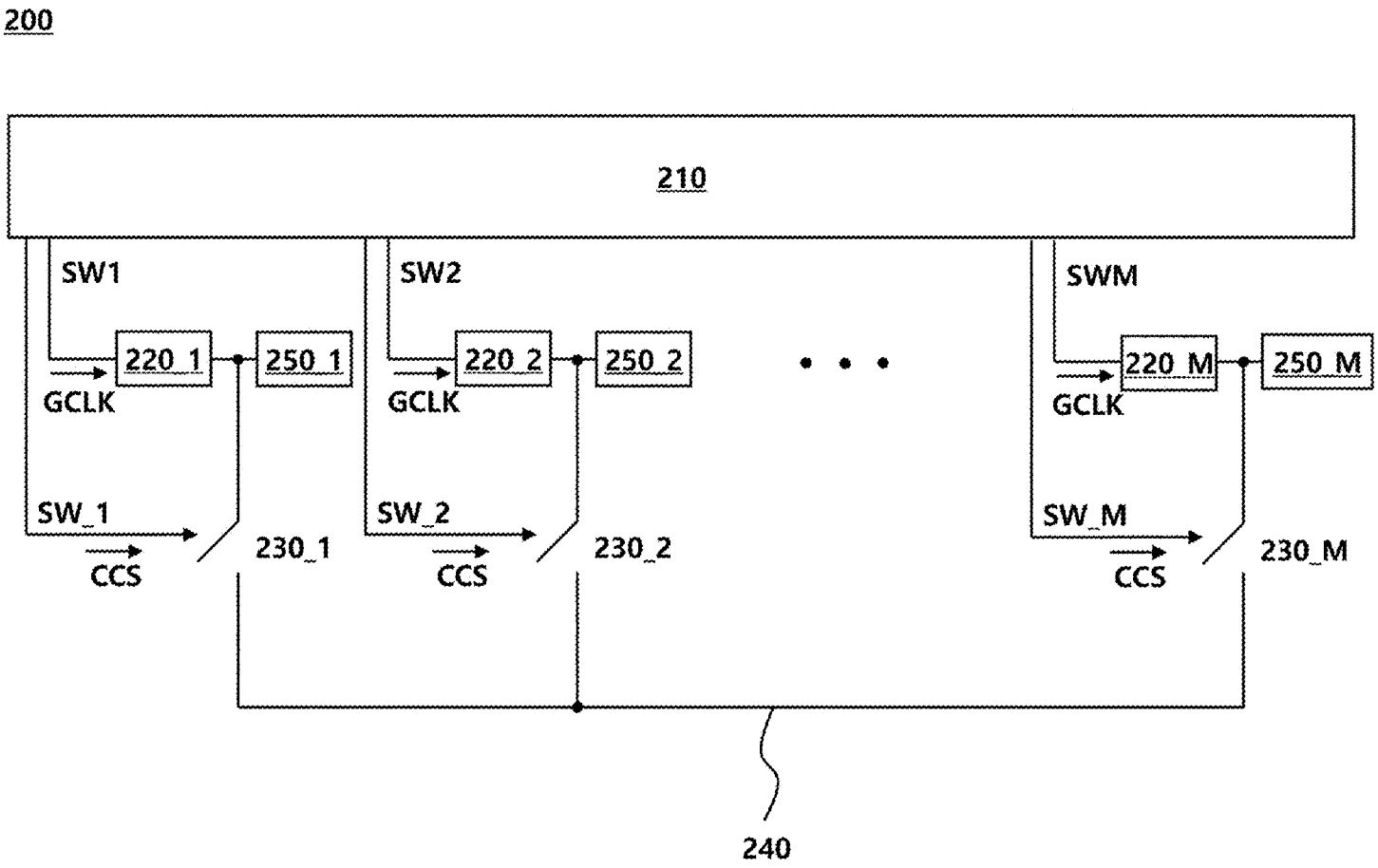
FIG. 2 is a diagram for explaining a gate driver circuit in accordance with an embodiment.

FIG. 2 is a diagram for explaining a circuit 200 for a gate driver in accordance with an embodiment.

Referring to FIG. 2, the circuit 200 for a gate driver in accordance with the present embodiment may include a control circuit 210 that generates gate clock signals GCLK and connection control signals CCS, a plurality of buffers 220_1, 220_2, . . . , 220_M that amplify the gate clock signals GCLK to output the amplified gate clock signals GCLK, a plurality of charge sharing switches 230_1, 230_2, . . . , 230_M that are connected to output ends of the plurality of buffers 220_1, 220_2, . . . , 220_M, respectively, and controlled by the connection control signals CCS generated by the control circuit 210, and a charge sharing line 240 that connects the plurality of charge sharing switches 230_1, 230_2, . . . , 230_M.

The circuit 200 for a gate driver may include lines SW1, SW2, . . . , SWM that connect the control circuit 210 and input ends of the plurality of buffers 220_1, 220_2, . . . , 220_M, respectively, so that the plurality of buffers 220_1, 220_2, . . . , 220_M and the control circuit 210 are connected, and charge sharing switch control lines SW_1, SW_2, . . . , SW_M that connect the control circuit 210 and the plurality of charge sharing switches 230_1, 230_2, . . . , 230_M in order to control the plurality of charge sharing switches 230_1, 230_2, . . . , 230_M.

The output ends of the plurality of buffers 220_1, 220_2, . . . , 220_M may be connected to the panel 110. When viewed from the output ends of the plurality of buffers 220_1, 220_2, . . . , 220_M, the panel 110 connected to the output ends of the plurality of buffers 220_1, 220_2, . . . , 220_M may be understood as a panel load 250 including a resistor R and a capacitor C, and it may be understood that a plurality of panel loads 250_1, 250_2, . . . , 250_M are connected to the plurality of buffers 220_1, 220_2, . . . , 220_M, respectively.

It may be understood that the plurality of panel loads 250_1, 250_2, . . . , 250_M are connected to the output ends of the plurality of buffers 220_1, 220_2, . . . , 220_M and the plurality of charge sharing switches 230_1, 230_2, . . . , 230_M, and lines for connecting the plurality of panel loads 250_1, 250_2, . . . , 250_M and the output ends of the plurality of buffers 220_1, 220_2, . . . , 220_M may be connected to the plurality of charge sharing switches 230_1, 230_2, . . . , 230_M. Therefore, it may be understood that the plurality of panel loads 250_1, 250_2, . . . , 250_M, the plurality of buffers 220_1, 220_2, . . . , 220_M, and the plurality of charge sharing switches 230_1, 230_2, . . . , 230_M are connected through one node.

A timing controller 150 may generate an on-clock signal and an off-clock signal and transmit the generated on-clock signal and off-clock signal to the control circuit 210, which is included in the circuit 200 for a gate driver, in order to control the circuit 200 for a gate driver.

The control circuit 210 may receive the on-clock signal and the off-clock signal from the timing controller 150 separately provided outside the circuit 200 for a gate driver, and generate the gate clock signals GCLK on the basis of the on-clock signal and the off-clock signal received from the timing controller 150.

The control circuit 210 may sequentially transmit the generated gate clock signals GCLK to the plurality of buffers 220_1, 220_2, . . . , 220_M. Accordingly, phases of the respective gate clock signals GCLK transmitted to the plurality of buffers 220_1, 220_2, . . . , 220_M are not the same as one another.

The control circuit 210 may generate the connection control signals CCS, and transmit the connection control signals CCS to the charge sharing switches 230_1, 230_2, . . . , 230_M through the charge sharing switch control lines SW_1, SW_2, . . . , SW_M that control the plurality of charge sharing switches 230_1, 230_2, . . . , 230_M, thereby controlling the on/off of the charge sharing switches 230_1, 230_2, . . . , 230_M.

The control circuit 210 may determine whether to transmit the connection control signals CCS to the charge sharing switches 230_1, 230_2, . . . , 230_M, which correspond to the plurality of buffers 220_1, 220_2, . . . , 220_M, respectively, according to the phases of the gate clock signals GCLK transmitted to the plurality of buffers 220_1, 220_2, . . . , 220_M, respectively.

The control circuit 210 may include a counting circuit that counts the number of on-clock signal pulses between an initial on-clock signal pulse and an initial off-clock signal pulse transmitted by the timing controller 150. Since the counting circuit provided in the control circuit 210 counts the number of on-clock signal pulses between the initial on-clock signal pulse and the initial off-clock signal pulse transmitted by the timing controller 150, it can be deemed that the control circuit 210 counts the number of on-clock signal pulses between the initial on-clock signal pulse and the initial off-clock signal pulse transmitted by the timing controller 150.

The respective input ends of the plurality of buffers 220_1, 220_2, . . . , 220_M may be connected to the control circuit 210 through the lines SW1, SW2, . . . , SWM that connect the plurality of buffers 220_1, 220_2, . . . , 220_M, and the plurality of buffers 220_1, 220_2, . . . , 220_M may receive the gate clock signals GCLK from the control circuit 210, and amplify the gate clock signals GCLK to output the amplified gate clock signals GCLK.

The output ends of the plurality of buffers 220_1, 220_2, . . . , 220_M may be, respectively connected to the plurality of panel loads 250_1, 250_2, . . . , 250_M and the plurality of charge sharing switches 230_1, 230_2, . . . , 230_M through one node.

The buffer 220_1 may include a PMOS transistor QP1 and a NMOS transistor QN1, the buffer 220_2 may include a PMOS transistor QP2 and a NMOS transistor QN2, and the buffer 220_M may include a PMOS transistor QPM and a NMOS transistor QNM.

The plurality of charge sharing switches 230_1, 230_2, . . . , 230_M may be, respectively connected to the output ends of the plurality of buffers 220_1, 220_2, . . . , 220_M and the plurality of panel loads 250_1, 250_2, . . . , 250_M through one node.

The plurality of charge sharing switches 230_1, 230_2, . . . , 230_M may be interconnected by the charge sharing line 240.

The plurality of charge sharing switches 230_1, 230_2, . . . , 230_M may be turned on and off by the connection control signal CCS received from the control circuit 210 through the charge sharing switch control lines SW_1, SW_2, . . . , SW_M.

The plurality of charge sharing switches 230_1, 230_2, . . . , 230_M may each include a transistor.

The charge sharing line 240 may include one line that connects the plurality of charge sharing switches 230_1, 230_2, . . . , 230_M.

The charge sharing line 240 may serve to connect an output end of a buffer, which outputs a gate clock signal GCLK in a falling edge state, and an output end of a buffer, which outputs a gate clock signal GCLK in a rising edge state, and thus charge sharing is achieved. Here, the falling edge may refer to a state in which a signal value is reduced from a specific value in a clock signal. For example, the falling edge may mean a moment where the value of a clock signal is changed from 1 to 0. The rising edge may refer to a state in which a signal value rises to a specific value in a clock signal. For example, the rising edge may mean a moment where the value of a clock signal is changed from 0 to 1.

Since the charge sharing line 240 includes one line, the configuration of the circuit can be simplified.

The related art has a problem in that since a charge sharing function is performed by inputting a separate signal to each channel in which charge sharing is desired to be achieved, a user needs to directly designate a channel in which the charge sharing function is to be performed.

However, in the present embodiment, the plurality of charge sharing switches 230_1, 230_2, . . . , 230_M may be connected through the one charge sharing line 240, and the control circuit 210 may control the plurality of charge sharing switches 230_1, 230_2, . . . , 230_M by using the phase of a clock signal and adaptively select an output end of a buffer in which a charge sharing function is to be performed.

Figure 3:
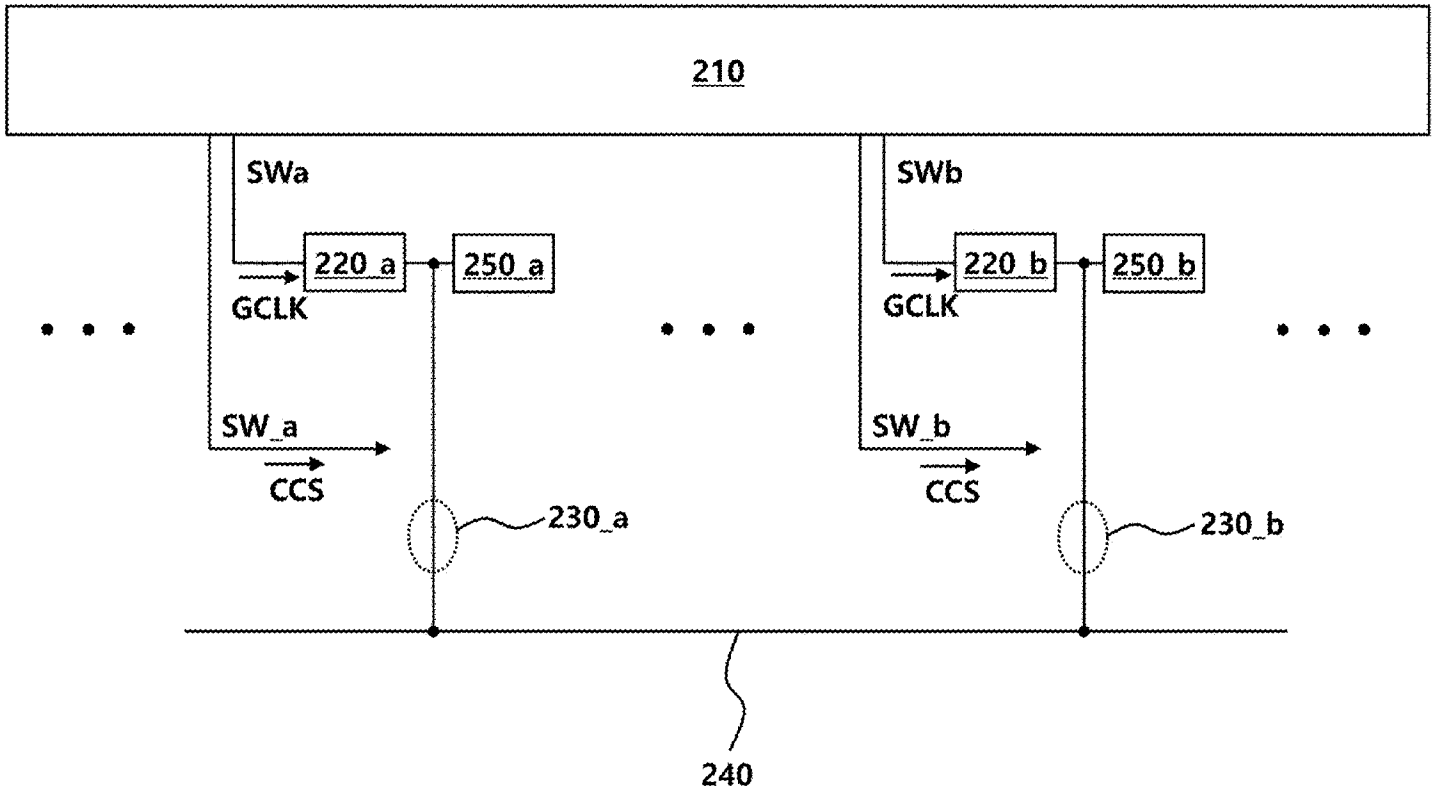
FIG. 3 is a diagram for explaining a circuit in which charge sharing switches are turned on in accordance with an embodiment.

FIG. 3 is a diagram for explaining a circuit in which charge sharing switches are turned on.

Referring to FIG. 3, the control circuit 210 may transmit the connection control signal CCS to charge sharing switches 230_*a* and 230_*b*, which enable charge sharing among the plurality of charge sharing switches 230_1, 230_2, . . . , 230_M, by using the phase of the gate clock signal GCLK transmitted to the plurality of buffers 220_1, 220_2, . . . , 220_M, thereby turning on the charge sharing switches 230_*a* and 230_*b*.

It may be determined which of the plurality of charge sharing switches 230_1, 230_2, . . . , 230_M are to be turned on by the control circuit 210, according to the phase of the gate clock signal GCLK received by output ends of a first buffer 220_*a* and a second buffer 220_*b* among the plurality of buffers 220_1, 220_2, . . . , 220_M connected to the plurality of charge sharing switches 230_1, 230_2, . . . , 230_M, respectively. The first buffer 220_*a* and the second buffer 220_*b* may be selected from among the plurality of buffers 220_1, 220_2, . . . , 220_M.

Specifically, a first gate clock signal and a second gate clock signal may be transmitted to the first buffer 220_*a* and the second buffer 220_*b*, respectively among the plurality of buffers 220_1, 220_2, . . . , 220_M, and the charge sharing switches 230_*a* and 230_*b* corresponding to the output end of the first buffer 220_*a* and an output end of the second buffer 220_*b* may be turned on when the first gate clock signal and the second gate clock signal are in different edge states.

In accordance with an embodiment related to the above, the first gate clock signal and the second gate clock signal may be transmitted to the first buffer 220_*a* and the second buffer 220_*b*, respectively among the plurality of buffers 220_1, 220_2, . . . , 220_M, and when the first gate clock signal is in a falling edge state and the second gate clock signal is in a rising edge state, the control circuit 210 may turn on the charge sharing switches 230_*a* and 230_*b* corresponding to the output end of the first buffer 220_*a* and the output end of the second buffer 220_*b*. Then, when the first gate clock signal is in a rising edge state and the second gate clock signal is in a falling edge state at the same time, the control circuit 210 may turn on the charge sharing switches 230_*a* and 230_*b* corresponding to the output end of the first buffer 220_*a* and the output end of the second buffer 220_*b*.

As the first charge sharing switch 230_*a* connected to the first buffer 220_*a* and the second charge sharing switch 230_*b* connected to the second buffer 220_*b* are turned on by the control circuit 210, the output ends of the first buffer 220_*a* and the second buffer 220_*b* are connected to each other through the charge sharing line 240, so that the charge sharing function may be performed.

Accordingly, a user does not directly select a channel in which the charge sharing function is to be performed, and may adaptively select the channel according to the phase of a clock signal.

The control circuit 210 may include the counting circuit that counts the number of on-clock signal pulses between the initial on-clock signal pulse and the initial off-clock signal pulse transmitted by the timing controller 150. Since the counting circuit provided in the control circuit 210 counts the number of on-clock signal pulses between the initial on-clock signal pulse and the initial off-clock signal pulse transmitted by the timing controller 150, it can be deemed that the control circuit 210 counts the number of on-clock signal pulses between the initial on-clock signal pulse and the initial off-clock signal pulse transmitted by the timing controller 150.

Since the gate clock signals GCLK generated by the control circuit 210 have an interval between the initial on-clock signal pulse and the initial off-clock signal pulse and are sequentially transmitted to the plurality of buffers 220_1, 220_2, . . . , 220_M at a predetermined cycle, it is possible to predict and determine the first gate clock signal and the second gate clock signal having different edge states by counting the number of on-clock signal pulses between the initial on-clock signal pulse and the initial off-clock signal pulse transmitted by the timing controller 150.

In accordance with an embodiment related to the above, it is possible to predict and determine the first buffer 220_*a* that receives the first gate clock signal in a falling edge state and the second buffer 220_*b* that receives the second gate clock signal in a rising edge state at the same time, and it is possible to predict and determine the first buffer 220_*a* that receives the first gate clock signal in a rising edge state and the second buffer 220_*b* that receives the second gate clock signal in a falling edge state at the same time.

Accordingly, when the number of on-clock signal pulses between the initial on-clock signal pulse and the initial off-clock signal pulse is n (n is a positive integer), the second gate clock signal may be a gate clock signal that is outputted at an $n+1^{th}$ time after the first gate clock signal is outputted.

The turned-on charge sharing switches 230_*a* and 230_*b* allow the output ends of the buffers 220_*a* and 220_*b*, which are connected to the turned-on charge sharing switches 230_*a* and 230_*b*, respectively, to be connected to each other through the charge sharing line 240.

When the output end of the first buffer 220_*a* and the output end of the second buffer 220_*b* are electrically balanced through the charge sharing, the control circuit 210 may turn off the charge sharing switch 230_*a* connected to the output end of the first buffer 220_*a* and the charge sharing switch 230_*b* connected to the output end of the second buffer 220_*b*.

Figure 4:
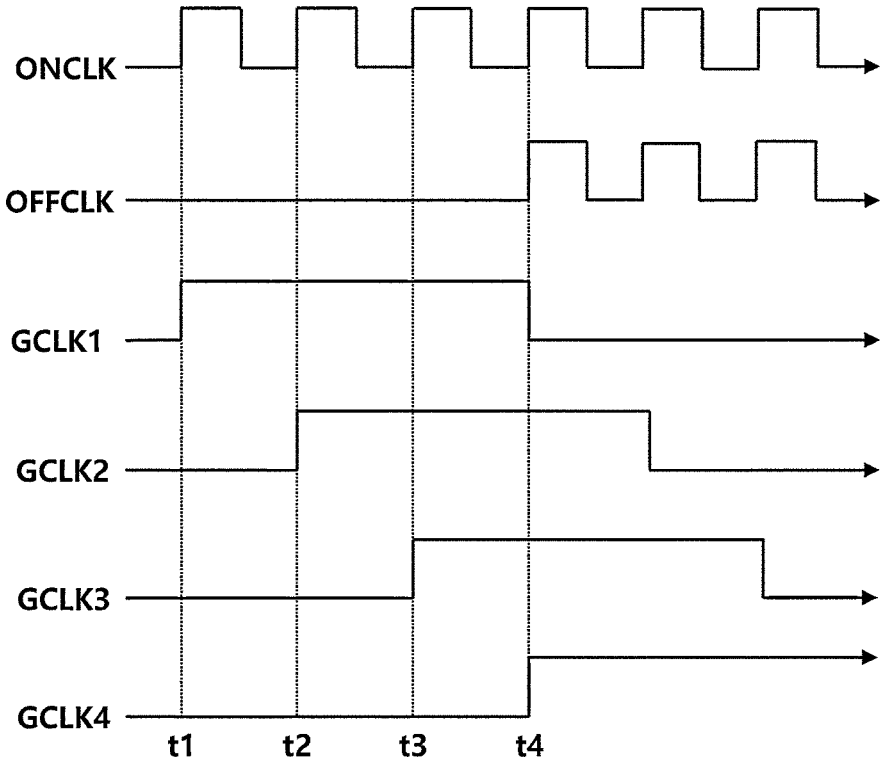
FIG. 4 is a diagram for explaining a waveform outputted from a buffer in accordance with an embodiment.

FIG. 4 is a diagram for explaining a waveform outputted from a buffer.

The timing controller 150 generates an on-clock signal ONCLK and an off-clock signal OFFCLK and transmits the generated on-clock signal ONCLK and off-clock signal OFFCLK to the control circuit 210. The control circuit 210 may receive the on-clock signal ONCLK and the off-clock signal OFFCLK, generate the gate clock signals GCLK on the basis of the received signals, and transmit the generated gate clock signals GCLK to the input ends of the plurality of buffers 220_1, 220_2, . . . , 220_M, respectively, and the plurality of buffers 220_1, 220_2, . . . , 220_M may amplify the received gate clock signals GCLK to output the amplified signals.

The gate clock signals GCLK generated by the control circuit 210 may have an interval between an initial on-clock signal pulse and an initial off-clock signal pulse.

Referring to FIG. 4, the plurality of buffers 220_1, 220_2, . . . , 220_M may sequentially receive the gate clock signals GCLK generated by the control circuit 210, at respectively times t1, t2, t3, t4, . . . , amplify the received gate clock signals GCLK, and sequentially output the amplified gate clock signals GCLK.

In accordance with an embodiment related to the above, at the time t4 at which a first buffer receives a first gate clock signal GCLK1 in a falling edge state among the amplified gate clock signals GCLK outputted by the plurality of buffers 220_1, 220_2, . . . , 220_M, charge sharing switches connected to an output end of a second buffer, which receives a second gate clock signal GCLK4 in a rising edge state, are turned on, and an output end of the first buffer and the output end of the second buffer are connected to each other through the charge sharing line 240, so that charge sharing can be achieved.

Figure 5:
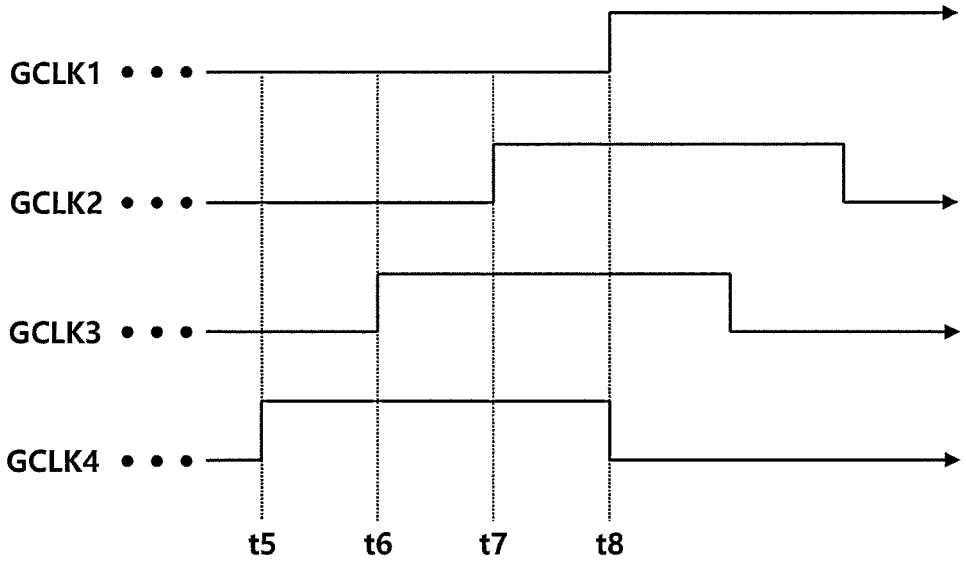
FIG. 5 is a diagram for further explaining a waveform outputted from a buffer in accordance with an embodiment.

FIG. 5 is a diagram for further explaining a waveform outputted from a buffer in accordance with an embodiment.

A first gate clock signal and a second gate clock signal may be transmitted to the first buffer 220_*a* and the second buffer 220_*b*, respectively, among the plurality of buffers 220_1, 220_2, . . . , 220_M, and the charge sharing switches 230_*a* and 230_*b* corresponding to the output end of the first buffer 220_*a* and the output end of the second buffer 220_*b* may be turned on when the first gate clock signal and the second gate clock signal are in different edge states.

Referring to FIG. 5, the plurality of buffers 220_1, 220_2, . . . , 220_M may sequentially receive the gate clock signals GCLK generated by the control circuit 210, at respectively times t5, t6, t7, t8, . . . , amplify the received gate clock signals GCLK, and sequentially output the amplified gate clock signals GCLK. In accordance with an embodiment related to the above, at the time t8 at which a first buffer receives a first gate clock signal GCLK1 in a rising edge state among the amplified gate clock signals GCLK outputted by the plurality of buffers 220_1, 220_2, . . . , 220_M, charge sharing switches connected to an output end of a second buffer, which receives a second gate clock signal GCLK4 in a falling edge state, are turned on, and an output end of the first buffer and the output end of the second buffer are connected to each other through the charge sharing line 240, so that charge sharing can be achieved.

Figure 6:
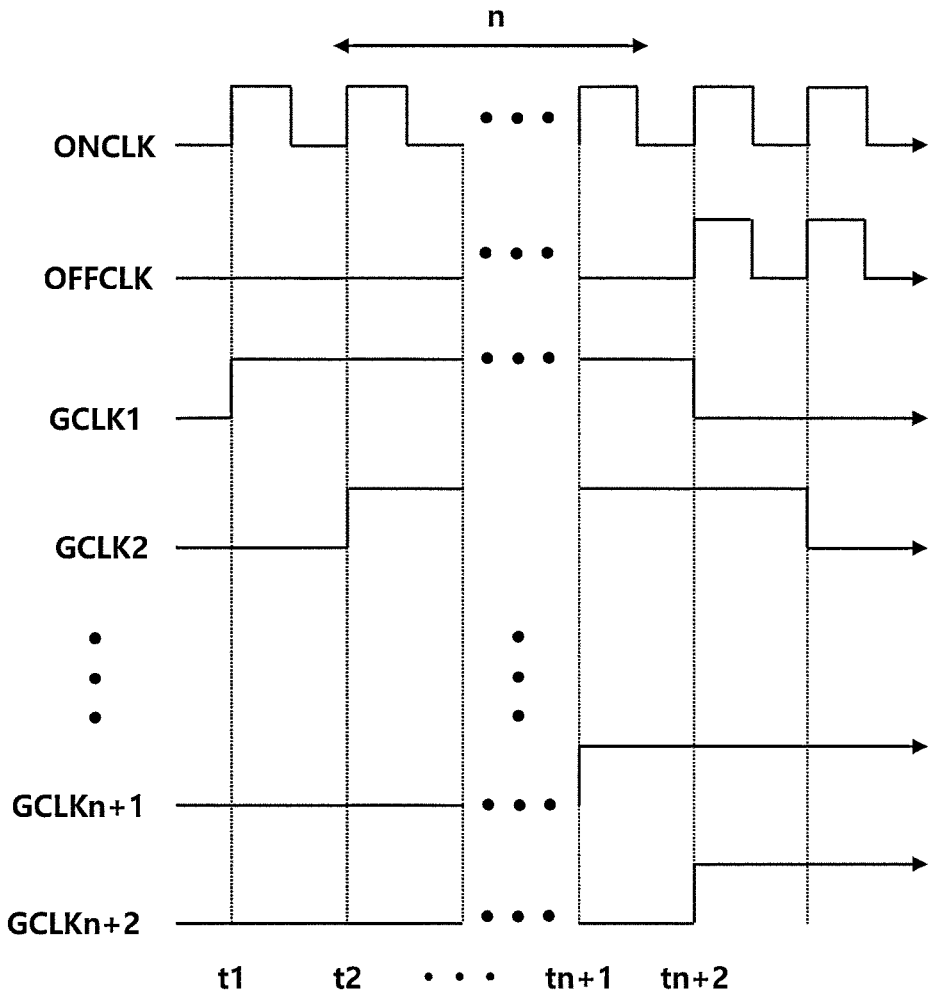
FIG. 6 is a diagram for explaining the counting of the number of pulses of a clock signal in order to select a charge sharing switch to be turned on in accordance with an embodiment.

FIG. 6 is a diagram for explaining the counting of the number of pulses of a clock signal in order to select a charge sharing switch to be turned on.

The control circuit 210 may include the counting circuit that counts the number of on-clock signal pulses between the initial on-clock signal pulse and the initial off-clock signal pulse transmitted by the timing controller 150. Since the counting circuit provided in the control circuit 210 counts the number of on-clock signal pulses between the initial on-clock signal pulse and the initial off-clock signal pulse transmitted by the timing controller 150, it can be deemed that the control circuit 210 counts the number of on-clock signal pulses between the initial on-clock signal pulse and the initial off-clock signal pulse transmitted by the timing controller 150.

The counting circuit included in the control circuit 210 may count the number of on-clock signal pulses between the initial on-clock signal pulse and the initial off-clock signal pulse, and predict and calculate an output end of a buffer to be connected, on the basis of the counting information and the fact that the gate clock signals GCLK are sequentially transmitted to the plurality of buffers 220_1, 220_2, . . . , 220_M.

Referring to FIG. 6, the gate clock signals GCLK generated on the assumption that there is an interval corresponding to n on-clock signal pulses (n is an arbitrary positive integer) between the initial on-clock signal pulse and the initial off-clock signal pulse may be signals having an interval corresponding to n+1 on-clock signal pulses. That is, the gate clock signals GCLK having different edge states may have an interval corresponding to the n+1 on-clock signal pulses.

In accordance with an embodiment related to the above, when it is assumed that there are n on-clock signal pulses (n is a positive integer) between the initial on-clock signal pulse and the initial off-clock signal pulse generated by the timing controller 150 and transmitted to the control circuit 210, a second gate clock signal in a rising edge state may be a gate clock signal that is outputted at an $n+1^{th}$ time after a first gate clock signal in a falling edge state is outputted. The first gate clock signal may be a signal generated at t1 and the second gate clock signal may be a signal generated at tn+2. Alternatively, they may be arbitrary two gate clock signals having the same interval.

Figure 7:
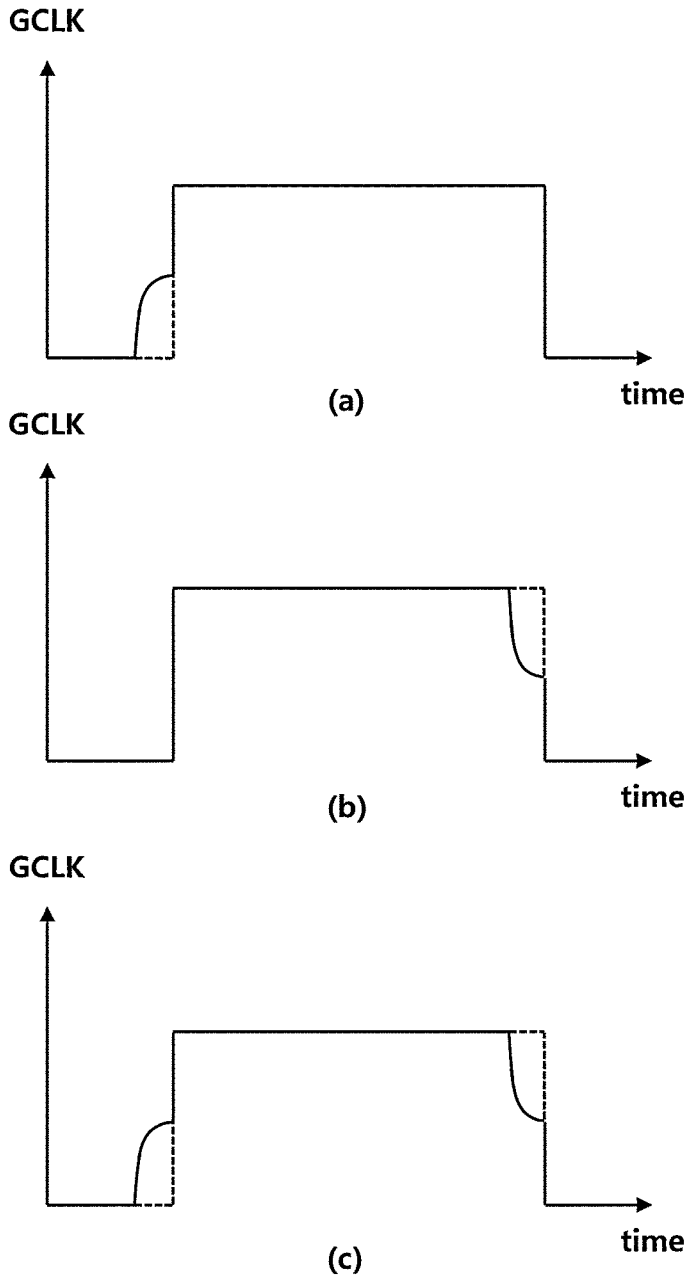
FIG. 7 is a diagram for explaining a clock pulse when charge sharing is achieved in accordance with an embodiment.

FIG. 7 is a diagram for explaining a clock pulse when charge sharing is achieved.

The plurality of charge sharing switches 230_1, 230_2, . . . , 230_M may each include a transistor, and even though the output ends of the buffers 220_1, 220_2, . . . , 220_M respectively connected to the charge sharing switches 230_1, 230_2, . . . , 230_M turned on by the on resistance of the transistors are connected to one another through the charge sharing line 240, the waveform of a charge-shared gate clock signal GCLK may have a gentle curve.

Referring to FIG. 7, charge sharing is achieved between an output end of a buffer, which amplifies a gate clock signal in a rising edge state to output the amplified signal, and an output end of a buffer that outputs a gate clock signal at a high level as illustrated in (a) of FIG. 7, so that the gate clock signal GCLK has a signal state at a specific level.

Furthermore, charge sharing is achieved between output end of a buffer, which amplifies a gate clock signal in a falling edge state to output the amplified signal, and an output end of a buffer that outputs a gate clock signal at a low level as illustrated in (b) of FIG. 7, so that the gate clock signal GCLK has a signal state at a specific level.

Accordingly, as illustrated in (c) of FIG. 7, charge sharing may be achieved at a rising edge and a falling edge of one pulse of a gate clock signal.

As a gate clock signal GCLK at a high level and a gate clock signal GCLK at a low level are electrically balanced, a driving voltage of the gate clock signal GCLK due to charge sharing has a smaller value than when charge sharing is not achieved. Thus, in the display device 100 including the circuit 200 for a gate driver in accordance with the present embodiment, power consumed when the gate line GL is driven can be significantly reduced.

Figure 8:
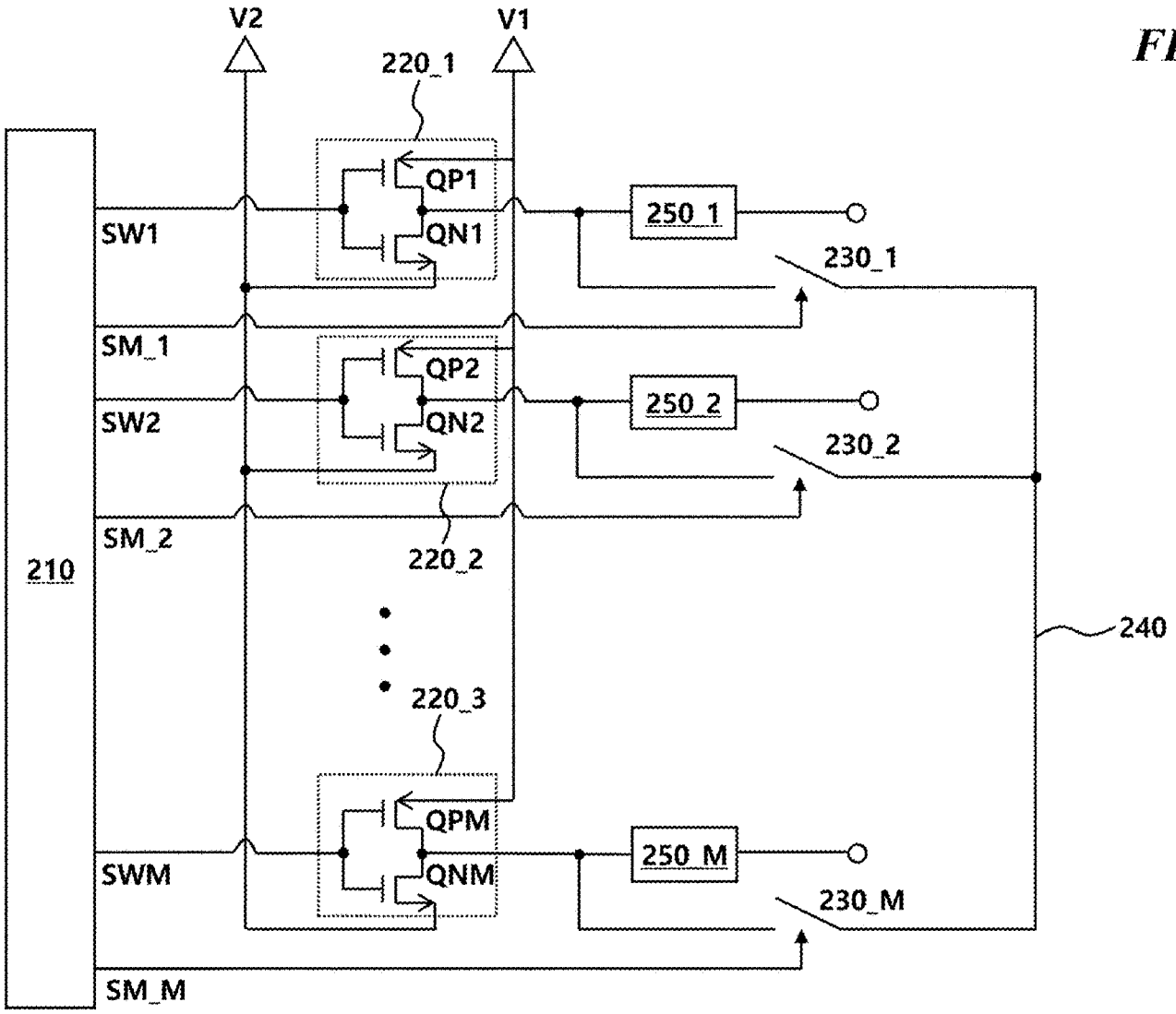
FIG. 8 is a diagram for explaining that a plurality of buffers each includes a PMOS transistor and an NMOS transistor in accordance with an embodiment.

FIG. 8 is a diagram for explaining that a plurality of buffers each includes a PMOS transistor and an NMOS transistor in accordance with an embodiment.

Referring to FIG. 8, the plurality of buffers 220_1, 220_2, . . . , 220_M may each include a PMOS transistor and an NMOS transistor.

The plurality of buffers 220_1, 220_2, . . . , 220_M may receive voltages from a first voltage source V1 and a second voltage source V2 in order to amplify the gate clock signal GCLK to output the amplified gate clock signal GCLK.

The PMOS transistor may include a gate end connected to the input end of each of the plurality of buffers 220_1, 220_2, . . . , 220_M, a source end connected to the first voltage source V1, and a drain end connected to the output end of each of the plurality of buffers 220_1, 220_2, . . . , 220_M.

The NMOS transistor may include a gate end connected to the input end of each of the plurality of buffers 220_1, 220_2, . . . , 220_M, a source end connected to the second voltage source V2, and a drain end connected to the output end of each of the plurality of buffers 220_1, 220_2, . . . , 220_M.

Figure 9:
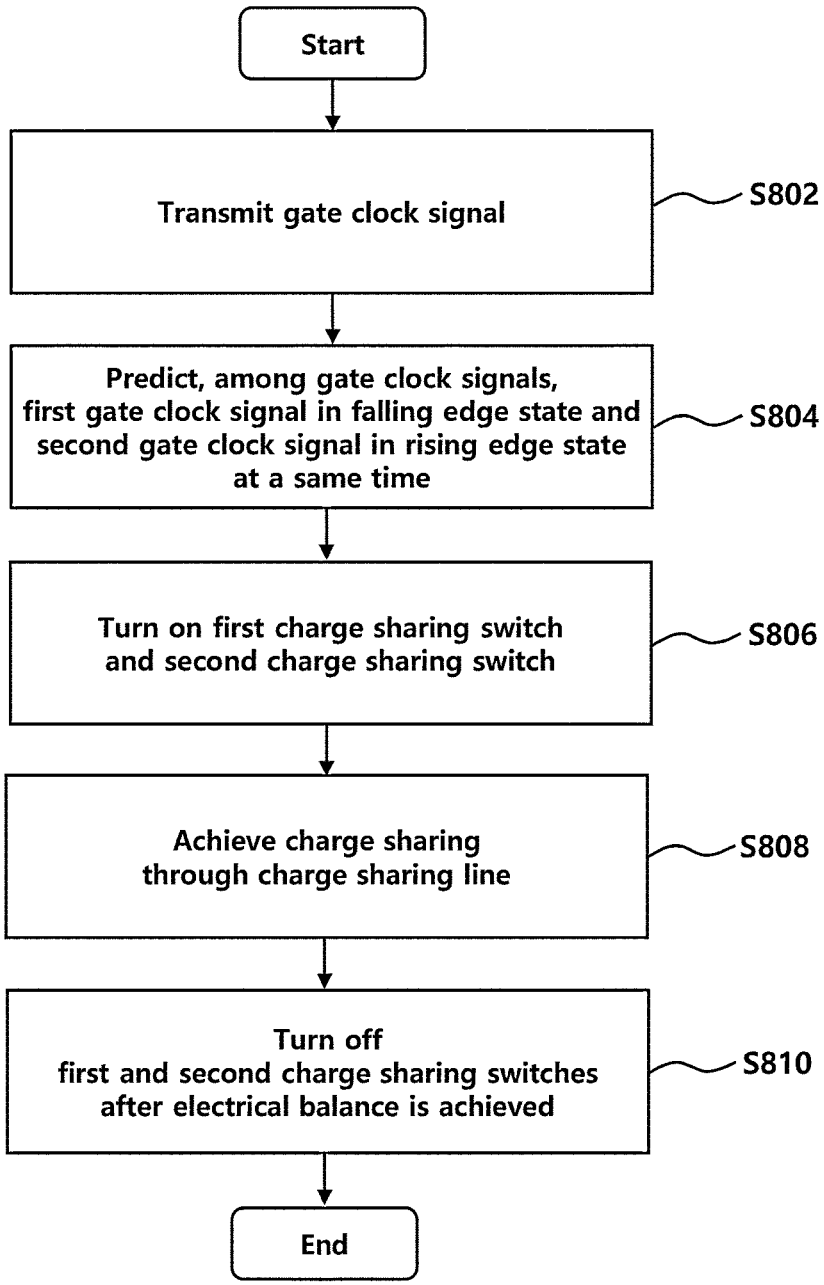
FIG. 9 is a diagram for explaining a driving process of the gate driver circuit in accordance with an embodiment.

FIG. 9 is a diagram for explaining a driving process of the gate driver circuit in accordance with an embodiment.

Referring to FIG. 9, a circuit driving method in accordance with the present embodiment may include a step S802 of transmitting the gate clock signals GCLK to the plurality of buffers 220_1, 220_2, . . . , 220_M, respectively.

An on-clock signal and an off-clock signal may be generated and outputted by the timing controller 150, and the control circuit 210 may receive the on-clock signal and the off-clock signal and generate and output a gate clock signal GCLK having an interval from an initial on-clock signal pulse to an initial off-clock signal pulse.

The control circuit 210 may be connected to the plurality of buffers 220_1, 220_2, . . . , 220_M through the input ends of the respective buffers.

The circuit driving method in accordance with the present embodiment may include a step S804 of predicting and determining buffers to which a first gate clock signal and a second gate clock signal in a falling edge state and a rising edge state, respectively, at the same time among the gate clock signals GCLK are transmitted.

The control circuit 210 may include the counting circuit that counts the number of on-clock signal pulses between the initial on-clock signal pulse and the initial off-clock signal pulse, and may understand an interval of the gate clock signal GCLK by counting the number of on-clock signal pulses between the initial on-clock signal pulse and the initial off-clock signal pulse. Since the counting circuit provided in the control circuit 210 counts the number of on-clock signal pulses between the initial on-clock signal pulse and the initial off-clock signal pulse transmitted by the timing controller 150, it can be deemed that the control circuit 210 counts the number of on-clock signal pulses between the initial on-clock signal pulse and the initial off-clock signal pulse transmitted by the timing controller 150.

Accordingly, it is possible to predict and determine an output end of a buffer, in which charge sharing is to be achieved, through the cycle of the gate clock signals GCLK sequentially transmitted and the interval of the gate clock signal GCLK.

The circuit driving method in accordance with the present embodiment may include a step S806 of turning on a first charge sharing switch and a second charge sharing switch corresponding to the output ends of buffers that receive the first gate clock signal and the second gate clock signal in the falling edge state and the rising edge state.

The first charge sharing switch and the second charge sharing switch may be turned on and off by the connection control signal CCS received from the control circuit 210.

The circuit driving method in accordance with the present embodiment may include a step S808 of connecting an output end of a first buffer and an output end of a second buffer through the charge sharing line 240.

The charge sharing line 240 may include a single line, and connect the plurality of charge sharing switches 230_1, 230_2, . . . , 230_M.

The plurality of charge sharing switches 230_1, 230_2, . . . , 230_M may each include a transistor, and when a charge sharing function is exhibited by the on resistance of the transistor, the waveform of a charge-shared gate clock signal GCLK may have a gentle curve.

The circuit driving method in accordance with the present embodiment may include a step S810 of turning off the first charge sharing switch and the second charge sharing switch connected to the first buffer and the second buffer, respectively, when the output end of the first buffer and the output end of the second buffer are electrically balanced.

As a gate clock signal GCLK at a high level and a gate clock signal GCLK at a low level are electrically balanced, a driving voltage of the gate clock signal GCLK due to charge sharing has a smaller value than when charge sharing is not achieved. Thus, in the display device 100 using the circuit driving method in accordance with the present embodiment, power consumed when the gate line GL is driven can be significantly reduced.

What is claimed is:

1. A gate driver circuit, comprising:

a control circuit configured to output gate clock signals and connection control signals;

a first buffer to receive a first gate clock signal from the control circuit and to output the first gate clock signal;

a second buffer to receive a second gate clock signal from the control circuit and to output the second gate clock signal;

a first charge sharing switch connected with an output end of the first buffer and controlled by the connection control signal; and a second charge sharing switch connected with an output end of the second buffer, connected with the first charge sharing switch through a charge sharing line, and controlled by the connection control signal, wherein the control circuit turns on the first charge sharing switch and the second charge sharing switch when the first gate clock signal and the second gate clock signal are respectively in different edge states.

2. The gate driver circuit according to claim 1, further comprising:

a first charge sharing switch control line to connect the control circuit and the first charge sharing switch and to transmit the connection control signal; and a second charge sharing switch control line to connect the control circuit and the second charge sharing switch and to transmit the connection control signal.

3. The gate driver circuit according to claim 1, wherein the control circuit determines whether to transmit the connection control signals according to phases of the first gate clock signal and the second gate clock signal.

4. The gate driver circuit according to claim 1, wherein the control circuit receives an on-clock signal and an off-clock signal from a timing controller and generates the gate clock signals based on the on-clock signal and the off-clock signal.

5. The gate driver circuit according to claim 4, wherein the control circuit comprises a counting circuit configured to count the number of on-clock signal pulses between an initial on-clock signal pulse and an initial off-clock signal pulse transmitted by the timing controller.

6. The gate driver circuit according to claim 5, wherein, when the number of on-clock signal pulses between the initial on-clock signal pulse and the initial off-clock signal pulse is n (a positive integer), the second gate clock signal is an $n+1^{th}$ gate clock signal outputted after the first gate clock signal has been outputted.

7. The gate driver circuit according to claim 6, wherein, when the output end of the first buffer and the output end of the second buffer are electrically balanced, the control circuit turns off the first charge sharing switch and the second charge sharing switch.

8. The gate driver circuit according to claim 4, wherein each of the first charge sharing switch and the second charge sharing switch comprises a transistor.

9. The gate driver circuit according to claim 1, wherein a waveform of a charge-shared gate clock signal has a gently curved shape by on resistance of the transistor.

10. The gate driver circuit according to claim 9, wherein the charge sharing line is a single line.

11. A method for driving a gate driver circuit, the method comprising:

transmitting a first gate clock signal to a first buffer;

transmitting a second gate clock signal to a second buffer;

turning on a first charge sharing switch connected with the first buffer and a second charge sharing switch connected with the second buffer when the first gate clock signal and the second gate clock signal are respectively in different edge states; and connecting an output end of the first buffer and an output end of the second buffer through a charge sharing line.

12. The method according to claim 11, further comprising:

receiving an on-clock signal and an off-clock signal and generating the first gate clock signal and the second gate clock signal based on the on-clock signal and the off-clock signal.

13. The method according to claim 12, further comprising:

counting the number of on-clock signal pulses between an initial on-clock signal pulse and an initial off-clock signal pulse and determining whether to turn on the first charge sharing switch and the second charge sharing switch.

14. The method according to claim 13, further comprising:

turning off the first charge sharing switch and the second charge sharing switch when the output end of the first buffer and the output end of the second buffer are electrically balanced.

* * * * *